US009275518B2

(12) United States Patent
Gura

(10) Patent No.: US 9,275,518 B2
(45) Date of Patent: Mar. 1, 2016

(54) MASH-UP WAGERING GAME CREATION

(71) Applicant: WMS Gaming, Inc., Waukegan, IL (US)

(72) Inventor: Damon E. Gura, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 361 days.

(21) Appl. No.: 13/786,544

(22) Filed: Mar. 6, 2013

(65) Prior Publication Data

US 2013/0184063 A1 Jul. 18, 2013

Related U.S. Application Data

(62) Division of application No. 13/057,290, filed as application No. PCT/US2009/052770 on Aug. 4, 2009, now Pat. No. 8,425,290.

(60) Provisional application No. 61/086,227, filed on Aug. 5, 2008.

(51) Int. Cl.
*G07F 17/32* (2006.01)

(52) U.S. Cl.
CPC ..... *G07F 17/326* (2013.01); *G07F 17/32* (2013.01); *G07F 17/323* (2013.01)

(58) Field of Classification Search
USPC ..... 717/104, 106
See application file for complete search history.

(56) References Cited

U.S. PATENT DOCUMENTS 6,366,876 B1 * 4/2002 Looney ..... 703/25
6,852,031 B1 2/2005 Rowe
7,191,435 B2 * 3/2007 Lau et al. ..... 717/168
7,917,890 B2 * 3/2011 Barcellona ..... 717/106
2003/0088684 A1 * 5/2003 Fisher ..... 709/230

(Continued)

FOREIGN PATENT DOCUMENTS

GB 2475648 5/2011
WO WO-2010017251 2/2010

OTHER PUBLICATIONS

"UK Application No. 1103866.8 Examination Report", Feb. 21, 2013, 8 pages.

(Continued)

*Primary Examiner* — Corbett B Coburn
(74) *Attorney, Agent, or Firm* — DeLizio Law, PLLC

(57) ABSTRACT

A wagering game developer can provide an online wagering game community, and receive continuous and current feedback about wagering games. The wagering game developer can use the online wagering game community to gauge popularity of wagering games, demonstrate wagering games, test wagering games, estimate wagering game life cycles, etc. Moreover, the wagering game developer can use the creativity of community members to modify and, perhaps, develop wagering games. The wagering game developer can decompose different aspects of a wagering game into executable code units that are platform independent, re-usable, and/or configurable ("wagering game widgets"). Users combine wagering game widgets, whether derived from a wagering game or user generated, to create a wagering game for playing in the online wagering game community. Wagering game developers can reward users who create the most popular wagering games, and develop proper versions of these user-created wagering games for deployment in wagering game establishments.

22 Claims, 7 Drawing Sheets

(56) References Cited

U.S. PATENT DOCUMENTS

| | | | | |
|---|---|---|---|---|
| 2004/0210865 | A1 | 10/2004 | Shimura | |
| 2005/0010892 | A1 | 1/2005 | McNair et al. | |
| 2005/0064940 | A1 | 3/2005 | Petruccelli | |
| 2005/0266906 | A1* | 12/2005 | Stevens | 463/1 |
| 2007/0129125 | A1 | 6/2007 | Van Luchene | |
| 2007/0183324 | A1 | 8/2007 | Cuberson et al. | |
| 2007/0283324 | A1* | 12/2007 | Geisinger | 717/120 |
| 2008/0009344 | A1* | 1/2008 | Graham et al. | 463/25 |
| 2008/0108435 | A1 | 5/2008 | Nelson et al. | |
| 2009/0204594 | A1 | 8/2009 | Akkiraju et al. | |
| 2009/0265760 | A1 | 10/2009 | Zhu et al. | |
| 2009/0328025 | A1* | 12/2009 | Johnson et al. | 717/170 |
| 2010/0153909 | A1* | 6/2010 | Batey et al. | 717/104 |
| 2011/0059800 | A1* | 3/2011 | Anderson et al. | 463/42 |
| 2011/0066477 | A1* | 3/2011 | Fujioka | 705/14.4 |
| 2011/0136569 | A1 | 6/2011 | Gura | |
| 2013/0065691 | A1* | 3/2013 | Gavish | 463/40 |
| 2014/0007057 | A1* | 1/2014 | Gill et al. | 717/126 |
| 2014/0130036 | A1* | 5/2014 | Gurikar et al. | 717/176 |

OTHER PUBLICATIONS

"PCT Application No. PCT/US09/52770 International Preliminary Report on Patentability", Sep. 20, 2010, 15 pages.

"PCT Application No. PCT/US09/52770 International Search Report", Sep. 17, 2009 , 9 pages.

"UK Application No. 1103866.8 Examination Report", Feb. 17, 2012, 2 pages.

"UK Application No. 1103866.8 Examination Report", Oct. 26, 2012, 6 Pages.

* cited by examiner

MASH-UP WAGERING GAME CREATION

RELATED APPLICATIONS

This application claims is a divisional application that claims benefit under 35 U.S.C. §119 of U.S. application Ser. No. 13/057,290, filed on Feb. 3, 2011. The Ser. No. 13/057,290 application is a 371 application of PCT Application No. PCT/US09/52770, filed on Aug. 4, 2009, which claims the benefit of U.S. Provisional Application No. 61/086,227 filed Aug. 5, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2013, WMS Gaming, Inc.

FIELD

Embodiments of the inventive subject matter relate generally to wagering game systems, and more particularly to generating wagering games.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the subjective entertainment value of the machine relative to other available gaming options. The subjective nature of entertainment value leads developers to offer a variety of gaming options. Wagering game developers expend creative resources and research continually evolve the variety of gaming options to offer leading edge wagering games with the greatest appeal.

BRIEF DESCRIPTION OF THE FIGURES

Embodiments are illustrated in the Figures of the accompanying drawings in which:

FIG. 3 depicts a flowchart of example operations for generating a wagering game from wagering game widgets. FIG. 4 depicts a flowchart of example operations that continue from FIG. 3.

DESCRIPTION OF THE EMBODIMENTS

The description that follows includes exemplary systems, methods, techniques, instruction sequences and computer program products that embody techniques of the present inventive subject matter. However, it is understood that the described embodiments may be practiced without these specific details. In other instances, well-known instruction instances, protocols, structures and techniques have not been shown in detail in order not to obfuscate the description.

Social networks and community driven websites offer entities access to a vast and dynamic pool of creativity, as well as feedback. A wagering game developer can provide an online wagering game community, and receive continuous and current feedback about wagering games. The wagering game developer can use the online wagering game community to gauge popularity of wagering games, demonstrate wagering games, test wagering games, estimate wagering game life cycles, etc. Moreover, the wagering game developer can use the creativity of community members to modify and, perhaps, develop wagering games. The wagering game developer can decompose different aspects of a wagering game into executable code units (e.g., interpreted code, on-the-fly compiled code, machine code, byte code, etc.) that are platform independent, re-usable, and/or configurable ("wagering game widgets"). Users combine wagering game widgets, whether derived from a wagering game or user generated, to create a wagering game for playing in the online wagering game community. Wagering game developers can reward users who create the most popular wagering games, and develop proper versions of these user-created wagering games for deployment in wagering game establishments.

Figure 1:
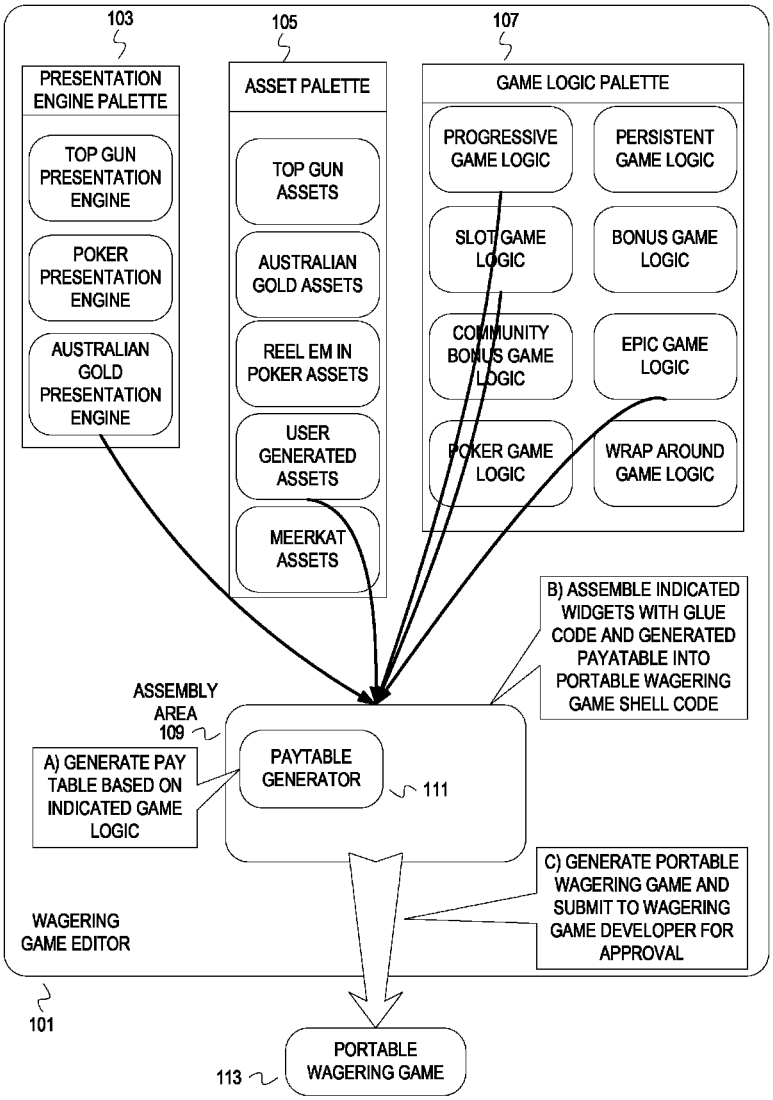
FIG. 1 depicts a conceptual diagram of an example wagering game editor generating a portable wagering game.

FIG. 1 depicts a conceptual diagram of an example wagering game editor generating a portable wagering game. A wagering game editor 101 provides an assembly area 109, a pay table generator 111, and widget palettes 103, 105, and 107. A user selects different widgets from the palettes 103, 105, and 107, and drags and drops the selected widgets into the assembly area 109 to construct a portable wagering game 113.

Each of the widget palettes 103, 105, and 107 contain widgets for different aspects of wagering games. The presentation engine palette 103 provides a Top Gun presentation engine widget, a poker presentation engine widget, and an Australian Gold presentation engine widget. Each of the presentation engine widgets comprises code that implements a presentation engine for the corresponding wagering game, but for a different environment. Instead of an electronic wagering game machine environment, the presentation engine widgets present aesthetic assets for wagering game activity (e.g., reel animation, card dealings, character animation sequences, wagering game banner messages, theme music, etc.) suitable for a portable dynamic environment (e.g., browser for a desktop, a browser for a mobile phone, a desktop application, a gaming console, etc.). The Top Gun presentation engine widget comprises executable code that displays the video reel animation, video sequences, audio, bonus images, etc. of the Top Gun wagering game. Similarly, the poker presentation engine widget and the Australian Gold presentation engine widgets comprise code that presents the aesthetic assets (e.g., visual and aural assets) for wagering game activity of a poker game and the Australian Gold wagering game.

The asset palette 105 provides a Top Gun assets widget, Australian Gold assets widget, Reel 'em In Poker assets widget, a user generated assets widget, and a Meerkat assets widget. Each of these asset widgets indicates images, sound effects, animation sequences, video sequences, music, etc. for the respective games. The user generated assets widget, however, indicates content created and/or selected by a user. For instance, the user generated assets widget may indicate personal photos of a user, user created animation sequences, and user created music. The assets widgets can be implemented to contain the aesthetic assets, reference the assets, reference some assets and contain other assets, etc. The asset widgets can also indicate permissions to use the assets (e.g., licenses).

The game logic palette 107 provides widgets that implement game logic for different types of wagering games. The game logic palette 107 provides a progressive game logic widget, a persistent game logic widget, a slot game logic widget, a bonus game logic widget, a community game logic widget, an epic game logic widget, a poker game logic widget, and a wrap around game logic widget.

In this example illustration, a user has dragged and dropped the Australian Gold presentation engine widget, the user generated assets widget, the progressive game logic widget, the slot game logic widget, and the epic game logic widget into the assembly area 109. At a stage A, the pay table generator 109 generates a pay table based on the indicated game logic widgets. At a stage B, the wagering game editor 101 assembles the indicated widgets with glue code and the generated pay table into a portable wagering game shell. The wagering game editor 101 can utilize glue code to pass arguments/values between the code of different widgets, creates calls to widget code, etc. The portable wagering game shell code provides the functionality for interfacing with input/output devices, selecting an image from the aesthetic assets widget to use as an icon or title image, etc. At a stage C, the wagering game editor 101 generates the portable wagering game 113 with an identification of the creator and submits the portable wagering game 113 to a wagering game developer for approval. After approval, the portable wagering game 113 can be deployed to the online wagering game community (e.g., made available for download, presented in a virtual casino, exported to a virtual world managed by a third party, etc.). Although not depicted, the wagering game editor 101 also allows a user to preview/test/modify a generated portable wagering game prior to submission of the portable wagering game for approval.

The wagering game developer may validate submitted portable wagering games to ensure the submitted wagering games do not violate intellectual property rights, present undesirable content, operate properly, etc. The wagering game developer can deploy approved portable wagering games, and track popularity of the portable wagering games, review comments on the deployed wagering games, etc. The wagering game developer can create a competition among the users by rewarding the user(s) who creates the most popular or top three most popular portable wagering games. The wagering game developer can offer additional rewards if a wagering game that is based on the portable wagering game is deployed into a wagering game establishment. The wagering game developer is not limited to rewarding users solely for wagering game creation. The wagering game developer can rewards users for selected user generated wagering game widgets, and even add those selected user generated widgets into a widget "toolbox" certified by the wagering game developer.

The wagering game developer can also provide functionality (in the wagering game editor or in a different tool) for creating an online casino of portable wagering games. A user can create an online casino with portable wagering games approved by the wagering game developer, and even third party wagering game developers. A casino mash-up editor can provide additional widgets for non-wagering game aspects of a casino (e.g., restaurants, shows, etc.). As with the portable wagering games, the wagering game developer can reward a creator(s) of a mash-up casino that surpasses a popularity threshold or is most popular. The configuration of successful mash-up casinos can be presented to wagering game establishments for consideration, used as templates in floor management applications, used to generate configuration data as heuristics consulted by a floor management application, derive data that represents the spatial relationships between wagering games in the mash-up casino, featured in brick and mortar at a wagering game establishment, etc.

Although the examples described above imply a manual process, validating submitted wagering game or casino floor configurations can be automated, for example with a validation engine. Rewarding creators can also be automated. A wagering game developer and/or a third-party can define a set of validation rules, which can be dynamic or static. The wagering game developer and/or third party can define rules ranging from generic to specific. A validation engine can be implemented separate from or as part of a wagering game editor. The validation engine can determine a mash-up wagering game or a mash-up casino as valid based on any one of validating all licenses (e.g., determining whether all non-user generated widgets have a valid license), validating configurations (e.g., ensuring configurations conform to specified accepted configurations), validating content (e.g., ensuring user generated content does not misuse assets of the wagering game developer or include offensive content), etc. If the validation engine approves (or validates) a mash-up wagering game or mash-up casino, then the validation engine can make the approved mash-up available in the online wagering game community and/or send out a notification of the approval. The validation engine can also automatically reward creators of the most popular mash-up. The validation engine can maintain metrics for approval and reward creators of a number of approved or percentage of approved mash-up beyond a threshold. Further, the validation engine can proxy contests established by an administrator.

FIG. 1 depicts a particular example wagering game editor for mash-up wagering game creation, but embodiments are not limited to the depicted example. For instance, the user interface is not limited to a drag-and-drop mechanism. A wagering game editor can be realized with radio buttons, drop down menus, text boxes, etc. In addition, the code implementing aspects of wagering games can be implemented differently. As an example, a widget can implement the presentation engine with the aesthetic assets for a particular game. A user can then modify the widget to use different assets, changing a tile image for example. Furthermore, the widgets can be configurable. A user can configure the percentages in the progressive game logic widget, configure wager denominations in a game logic widget, configure wager denominations in the generated portable wagering game, edit the wagering game shell code, etc.

Although FIG. 1 depicts some operations for generating a portable wagering game, a wagering game editor can be implemented with additional functionality. Constructing a portable wagering game from widgets that implement different aspects of a wagering game can also involve operations to determine compatibility of the indicated widgets, selection of glue code, etc.

Figure 2:
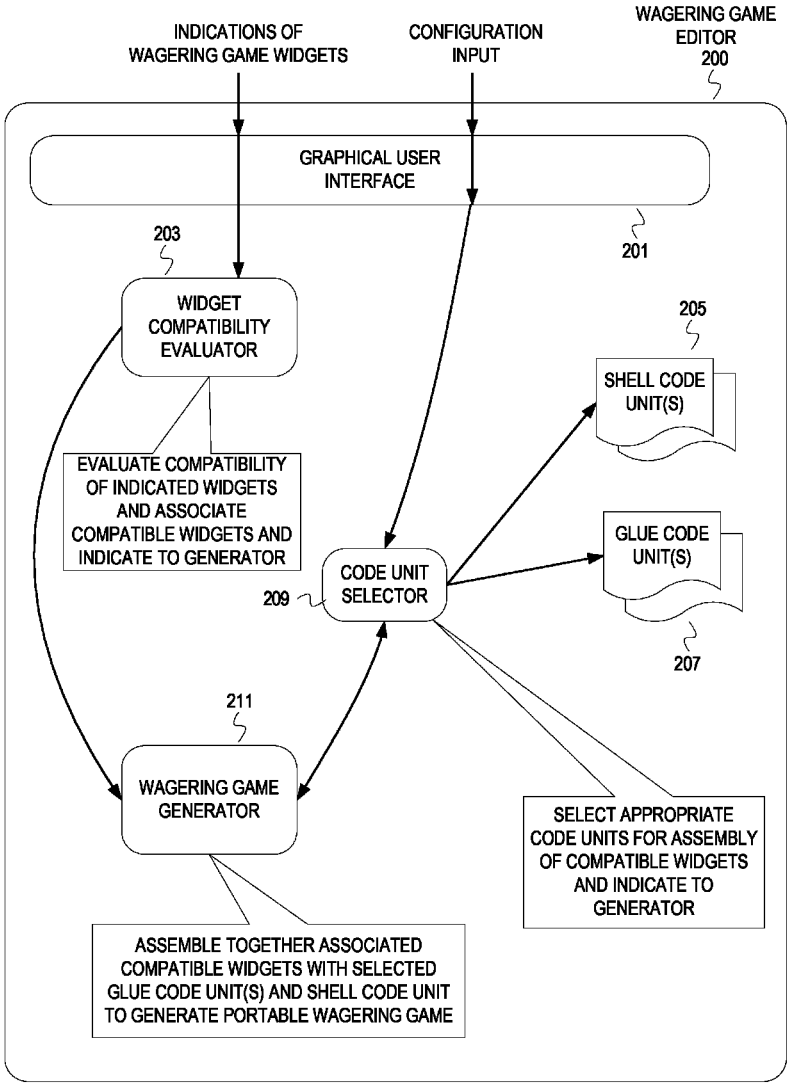
FIG. 2 depicts a conceptual diagram of example wagering game editor.

FIG. 2 depicts a conceptual diagram of example wagering game editor. A wagering game editor 200 comprises a graphical user interface 201, a widget compatibility evaluator 203, a code unit selector 209, and a wagering game generator 211. Although not necessary, the wagering game editor 200 is depicted as also comprising wagering game shell code units 205, and glue code units 207. Embodiments can implement the wagering game editor 200 to access the shell code units 205 and the glue code units 207 in a structure separate from the wagering game editor 200.

The units of the wagering game editor 200 operate to construct a wagering game from wagering game widgets. The graphical user interface 201 receives indications of wagering game widgets, and communicates those indications to the widget compatibility evaluator 203. The widget compatibility evaluator 203 evaluates compatibility of the indicated widgets. The widget compatibility evaluator 203 can examine a number and type of expected arguments/values, possible output values, etc., of the indicated wagering game widgets. The widget compatibility evaluator 203 associates compatible wagering game widgets, and indicates the associated compatible wagering game widgets to the wagering game generator 211.

The wagering game generator 211 requests one or more of the glue code units 207 and one of the wagering game shell code units 205 from the code unit selector 209. The code unit selector 209 selects, and possibly modifies, one or more of the glue code units 207 in accordance with the request from the wagering game generator, and any relevant configuration input from the graphical user interface 201. The code unit selector 209 also selects one of the glue code units 207 based on the request from the wagering game generator 211 and relevant configuration input from the graphical user interface 201, assuming more than one wagering game shell code unit is available. For instance, a wagering game editor may be limited to a wagering game shell code unit that provides a single type of wagering game with a single skin (e.g., a virtual slot machine for a virtual world). Embodiments, however, can provide wagering game shell code units for various type of wagering games (e.g., a virtual handheld wagering game machine, a virtual electronic wagering game machine, a virtual hologram wagering game, etc.), wagering game shell code units with different interfaces (e.g., a virtual world interface, an Internet browser interface, a standalone application, etc.), wagering game shell code units for different devices (e.g., a mobile phone a video game console, a touch screen computer, a desktop, tactile devices, etc.), etc. The selected shell code unit can govern how wagers are submitted, which can be configured. For instance, a user can configure wager denominations. The code unit selector 209 adapts a selected wagering game shell code unit in accordance with the input configuration (e.g., only 10 and 20 credit wagers are accepted, only wagers of virtual gemstones are accepted, wagers of time units for particular services, etc.). After selecting the appropriate ones of the code units 205 and 207, the code unit selector 209 indicates the selected code units to the wagering game generator for assembly of compatible widgets. The wagering game generator 211 assembles together the associated compatible widgets using the indicated one or more of the glue code units 207 and the selected one of the wagering game shell code units 205 to generate a wagering game.

Figure 3:
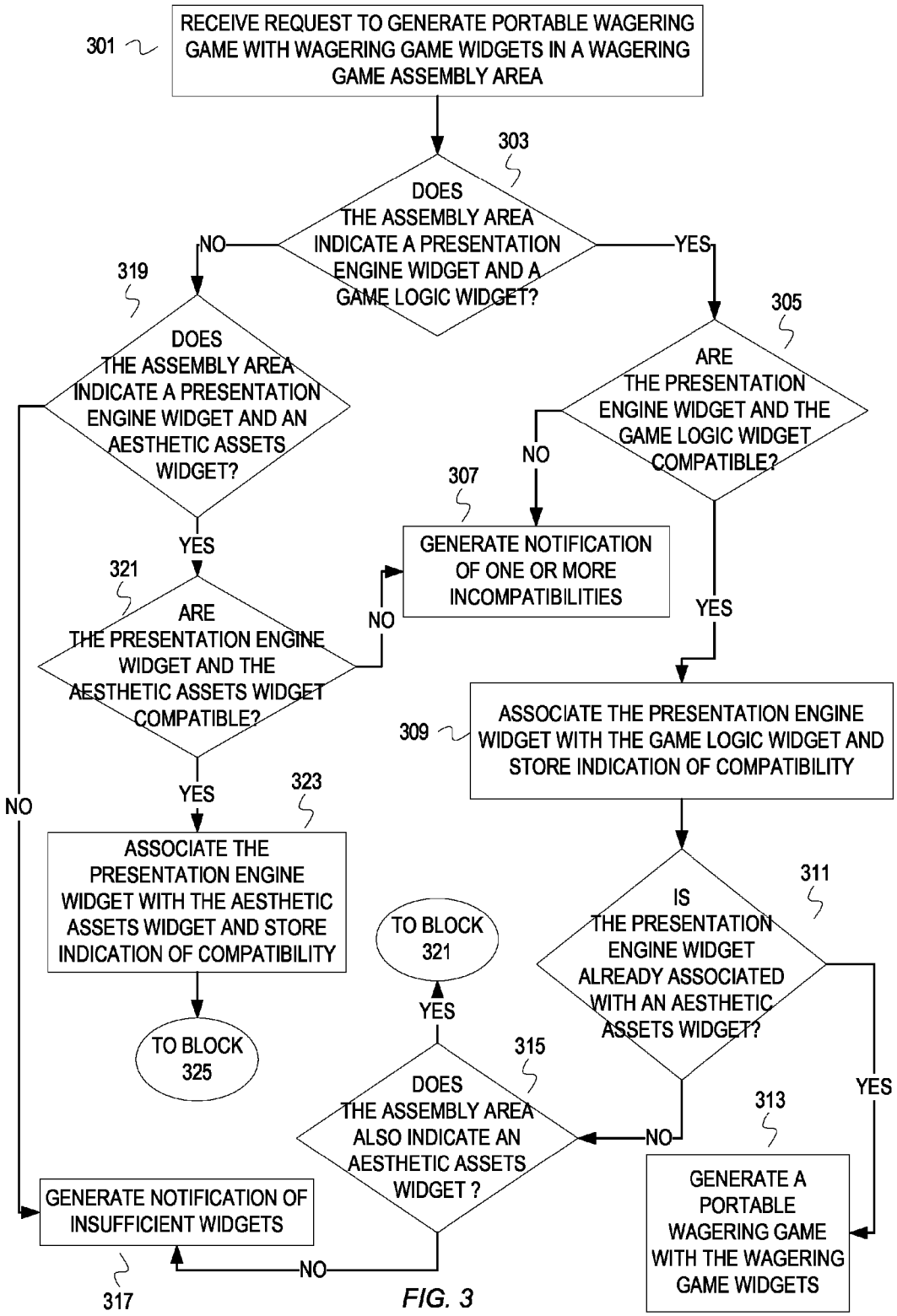
FIGS. 3-4 depicts flowcharts of example operations for generating a wagering game from wagering game widgets.
Figure 4:
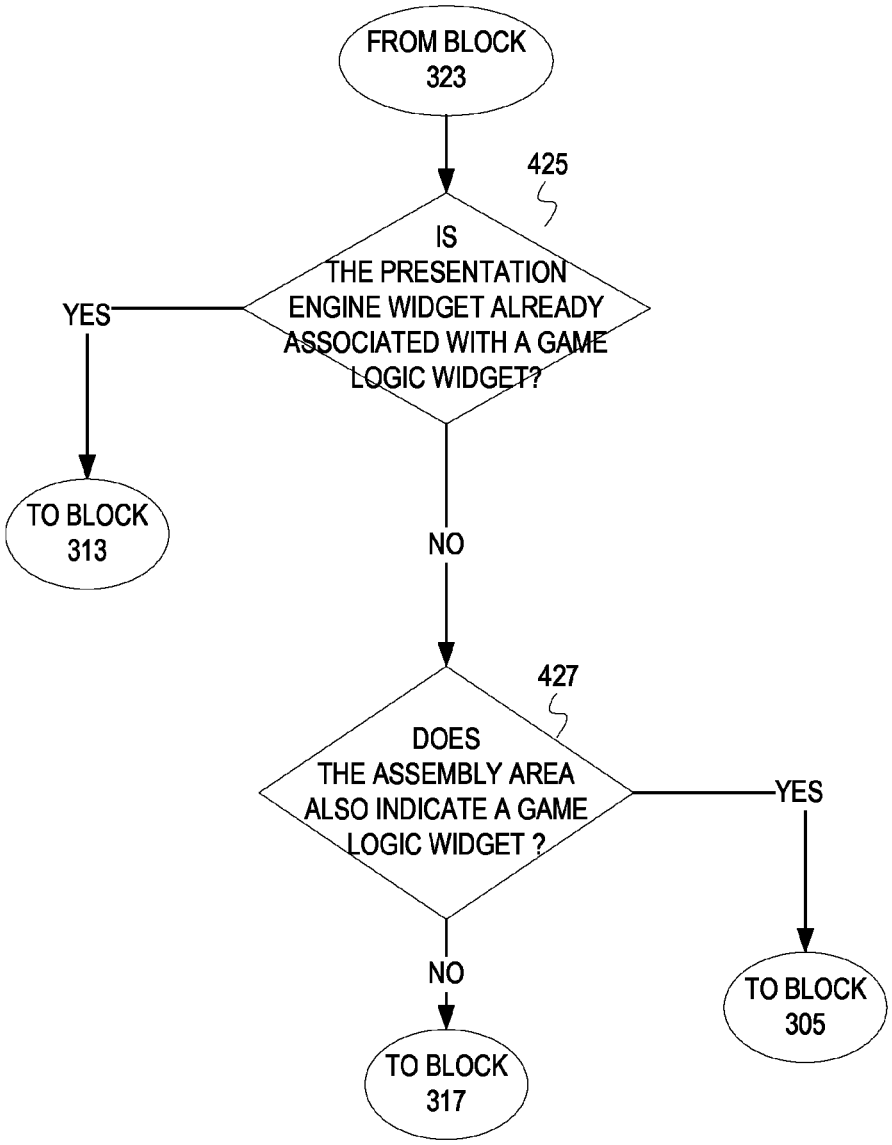

FIGS. 3-4 depicts flowcharts of example operations for generating a wagering game from wagering game widgets. FIG. 3 depicts a flowchart of example operations for generating a wagering game from wagering game widgets. At block 301, a request is received to generate a portable wagering game with wagering game widgets in an assembly area. For instance, a user selects a submit button on a wagering game editor, or the wagering game editor automatically attempts to construct a wagering game when contents of the assembly area change. Embodiments are not limited to this particular example mechanism. A wagering game editor may attempt to assemble wagering game widgets that are identified by ASCII text values in a text field instead of an a drag-and-drop assembly area, that are indicated with activated checkboxes, etc.

At block 303, it is determined if the assembly area indicates an wagering game presentation engine widget and a game logic widget. If the assembly area does not indicate these widgets, then control flows to block 319. If the assembly area indicates an wagering game presentation engine widget and a game logic widget, then control flows to block 305.

At block 305, it is determined if the wagering game presentation engine widget and the game logic widget are compatible. For instance, a widget compatibility evaluator determines if the wagering game presentation engine widget accepts a same number of wagering game events as output by the game logic widget. As another example, the evaluator may determine that the Meerkats wagering game presentation engine is not compatible with a poker game logic widget. If the wagering game presentation engine widget and the game logic widget are compatible, then control flows to block 309. If the asset presentation widget and the game logic widget are not compatible, then control flows to block 307.

At block 307, a notification is generated that indicates the one or more incompatibilities of the widgets. For instance, a message is displayed or one of the widgets is surrounded with flashing effects. In addition, a user may be given the option to ignore certain incompatibilities. For example, a user can choose to ignore that a game logic will not use theme music of an wagering game presentation engine widget.

If the widgets were determined to be compatible, then the wagering game presentation engine is associated with the game logic widget at block 309. In addition, an indication of the association is stored at block 309.

At block 311, it is determined if the wagering game presentation engine widget is already associated with an aesthetic assets widget. If not, then control flows to block 315. If the wagering game presentation engine widget is already associated with an aesthetic assets widget, then control flows to block 313.

At block 313, a portable wagering game is generated with the wagering game widgets.

If the wagering game presentation engine widget was not already associated with an aesthetic assets widget at block 311, then it is determined if the assembly area also indicates an aesthetic assets widget. If so, then control flows to block 321. If the assembly area does not also indicate an aesthetic assets widget, then control flows to block 317.

At block 317, a notification that insufficient widgets have been indicated is generated. For instance, a prompt for an additional wagering game widget of a particular category is displayed.

If the assembly area did not indicate an assets presentation engine widget and a game logic widget at block 303, then it is determined if the assembly area indicates an wagering game presentation engine widget and an aesthetic assets widget at block 319. If the assembly area does not indicate an assets presentation engine widget and an aesthetic assets widget, then control flows to block 317. Otherwise, control flows to block 321.

At block 321, it is determined if the wagering game presentation engine widget and the aesthetic assets widget are compatible. For example, a compatibility evaluator determines if the aesthetic assets widget indicates at least 30 images for reel tiles and at least two audio tracks for wins and losses to be compatible with the wagering game presentation engine widget. If not, then control flows to block 307. Otherwise, control flows to block 323.

At block 323, the wagering game presentation engine widget is associated with the aesthetic assets widget, and an indication of the association is stored. The indication of associations between widgets can be used to represent state of an assembly area. The indications of associations between widgets can also be used for assembly, for trial and error, to suggest combinations of widgets, etc. Control flows from block 323 to block 425 of FIG. 4.

FIG. 4 depicts a flowchart of example operations that continue from FIG. 3. At block 425, it is determined if the wagering game presentation engine widget is already associated with a game logic widget. If so, then control flows to block 313. If not, then control flows to block 427.

At block 427, it is determined if the assembly area also indicates a game logic widget. If the assembly area also indicates a game logic widget, then control flows to block 305. If not, then control flows to block 317.

Although the wagering game widgets can be created by users, wagering game developers will provide official/licensed widgets based on wagering games that have been deployed or are in development. The wagering game developers or a licensed third party can manually create wagering game widgets based on analysis of the wagering game code. Functionality can be implemented that analyzes wagering game code and automatically derives wagering game widgets based on the analysis.

Figure 5:
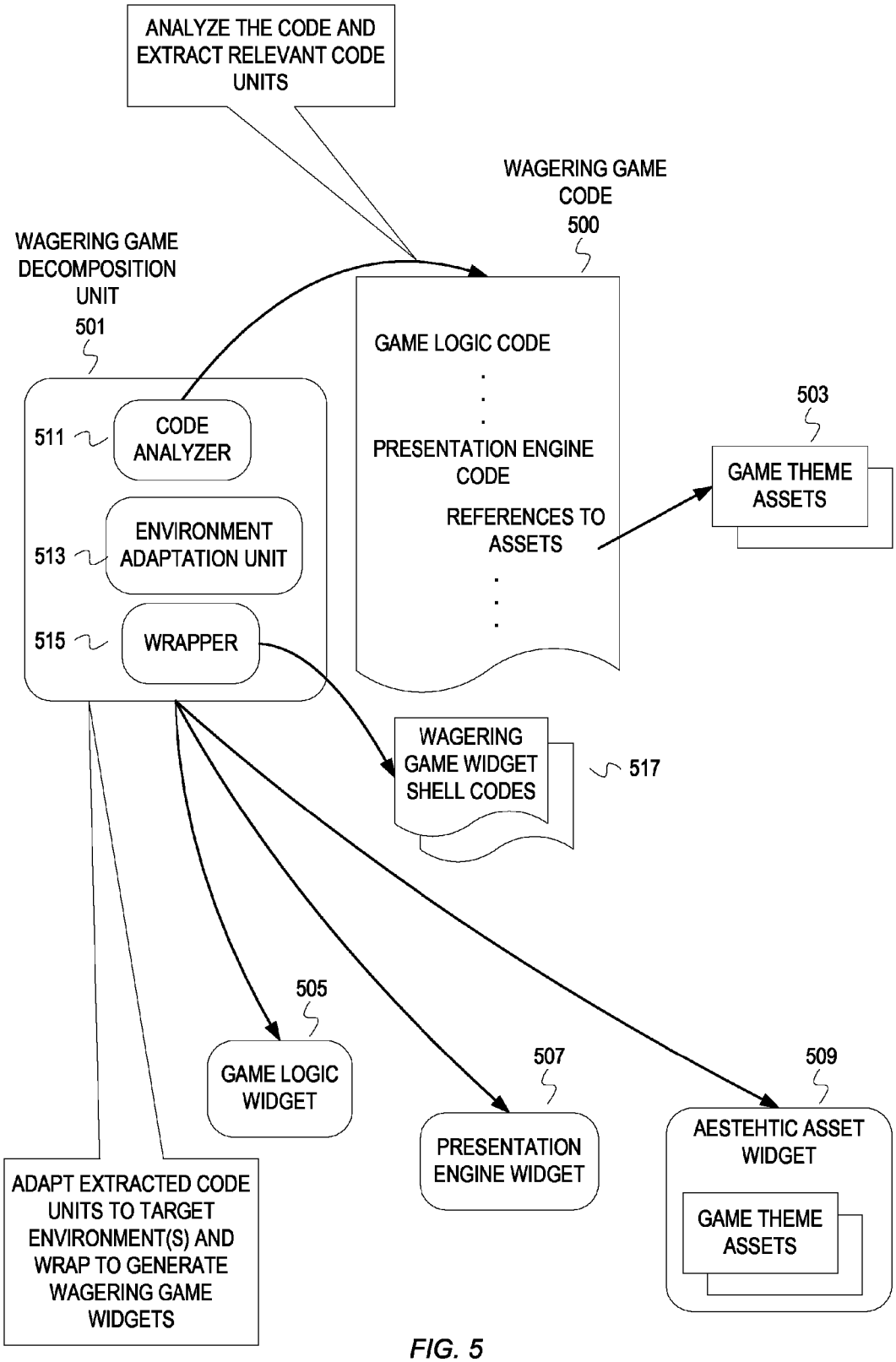
FIG. 5 depicts a conceptual diagram of an example wagering game decomposition unit.

FIG. 5 depicts a conceptual diagram of an example wagering game decomposition unit. A wagering game decomposition unit 501 analyzes code of a wagering game to decompose the wagering game code into code units that implement different aspects of the wagering game (e.g., presentation of visual, aural, and/or tactile responses to wagering game activity, game logic, etc.). The wagering game decomposition unit 501 derives wagering game widgets from the code units. The example wagering game decomposition unit 501 comprises a code analyzer 511, an environment adaptation unit 513, and a wrapper 515.

The code analyzer 511 analyzes a wagering game code 500. The wagering game code 500 can comprise source code, intermediate code, byte code, etc. The code analyzer 511 analyzes the wagering game code 500 to determine that the example wagering game code 500 comprises game logic code and aesthetic assets presentation engine code. The code analyzer 511 also determines that the aesthetic assets presentation engine code includes references to game theme assets 503. The code analyzer 511 can determine these different sections of code in the wagering game code 500 using heuristics and/or information in the wagering game code (e.g., comments, function names, tags, etc.). The code analyzer 511 also extracts the determined game logic code and wagering game presentation engine code as code units (e.g., copies the appropriate sections of the wagering game code 500). The code analyzer 511 also copies the game theme assets 503 as a code unit, although embodiments can store references (e.g., file names, metadata, addresses, etc.) to the game theme assets 503 as a code unit.

The environment adaptation unit 513 examines the extracted code units to determine if code modifications for adaptation to a target environment(s) are to be made. For instance, the environment adaptations unit 513 modifies the presentation engine code unit to output to a mobile screen instead of an electronic wagering game machine display. As another example, the environment adaptation unit 513 modifies the presentation engine to present a bonus game on a same display as the main game instead of on a separate display.

The wrapper 515 then wraps each of the extracted code units in an appropriate one of wagering game widget shell codes. The wagering game shell codes 517 provide a user interface for the target environment (e.g., browser environment, mobile phone, etc.) that presents a representation for the code units. For example, wagering game shell code can use a particular image from the game theme assets 530, perhaps indicated by the wrapper 515, within an icon of an electronic wagering game machine. The wagering game shell codes 517 also provide for configuration menus, input graphics, etc. After wrapping, the wagering game decomposition unit 501 generates a game logic widget 505, an wagering game presentation engine 507, and an aesthetic assets widget 509.

Figure 6:
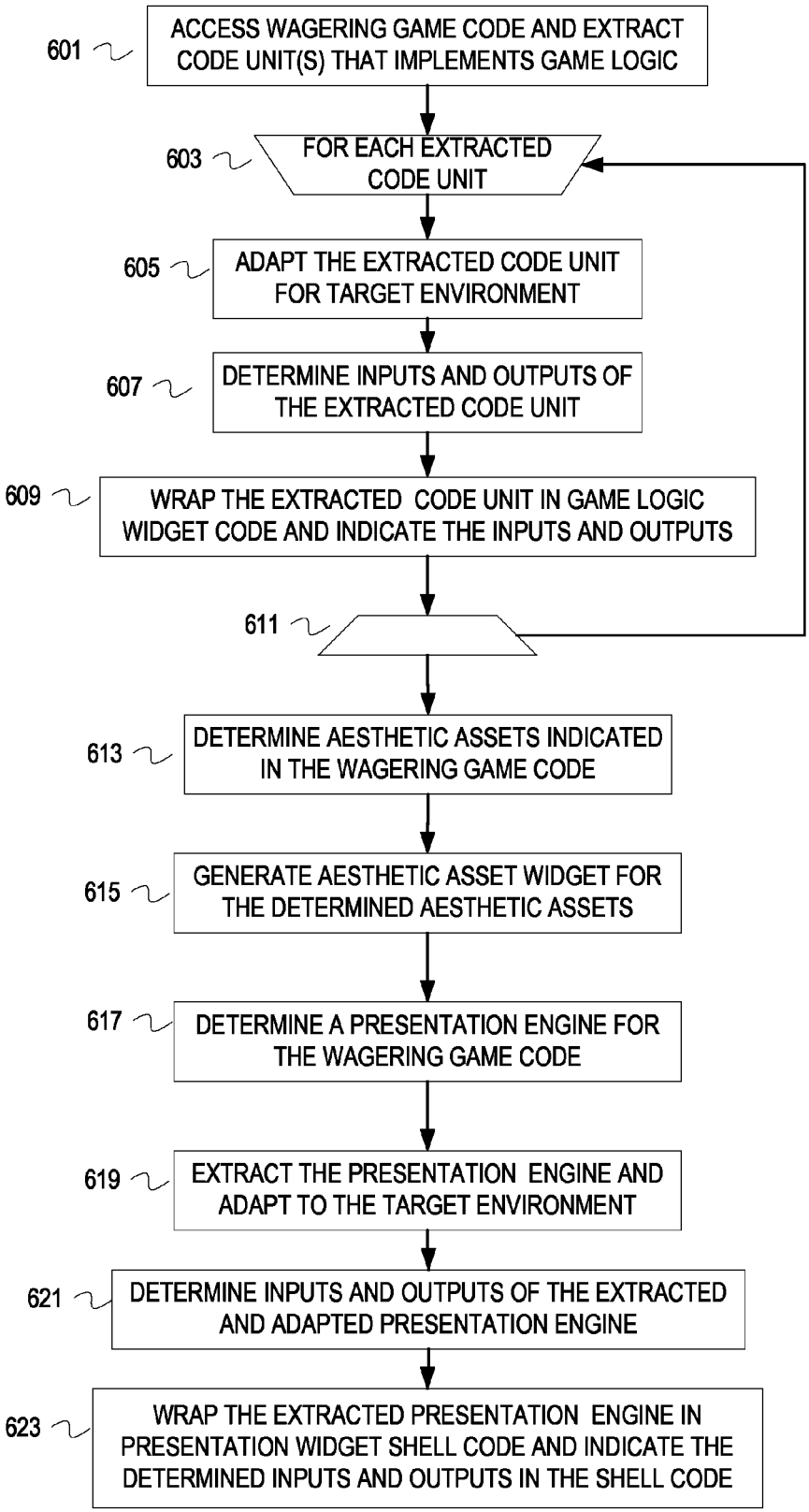
FIG. 6 depicts a flowchart of example operations for generating wagering game widgets.

FIG. 6 depicts a flowchart of example operations for generating wagering game widgets. At block 601, wagering game code is accessed, and one or more code units that implement game logic are extracted. Embodiments do not necessarily seek out a particular aspect of the wagering game. Embodiments can process aspects of a wagering game as encountered.

At block 603, a loop begins for each extracted code unit.

At block 605, the extracted code unit is adapted to one or more target environments.

At block 607, the inputs and outputs of the extracted code units are determined. For instance, the extracted code unit is examined to determine a number of arguments passed into the extracted code unit. The extracted code units can also be examined to determine argument types. The extracted code unit is also examined to determine values passed out. The determined information can be recorded into a separate document or file, written into the extracted code unit (e.g., as metadata or comments), etc.

At block 609, the extracted code unit is wrapped in game logic widget shell code and the inputs and outputs are indicated. For example, an argument list for the game logic widget shell code is created based on the recorded information about the extracted code units. The wagering game logic widget shell code can also be augmented to pass out any values as determined at block 607.

At block 611, the loop ends, and control either returns to block 603 or flows to block 613.

At block 613, aesthetic assets indicated in the wagering game code are determined. For instance, references to animation sequences, images, music, etc., are recorded.

At block 615, an aesthetic asset widget is generated for the determined aesthetic assets. The aesthetic asset widget can be annotated to indicate animation sequences as win sequences or lose sequences, to indicate images associated with larger win values, etc. The assets themselves can be tagged or annotated to indicate such information also, if not already done.

At block 617, a wagering game presentation engine is determined for the wagering game code. The wagering game presentation engine for a wagering game may not be a single section of code. The code that delivers aural and visual assets, for example, may be separate. A code analyzer can accumulate these different sections of code into a single code unit, or maintain them as separate code units. Although previous examples refer to a single wagering game presentation engine, multiple presentation engine widgets can be generated from wagering game code.

At block 619, the wagering game presentation engine is extracted and adapted to the target environment(s).

At block 621, the inputs and outputs of the extracted and adapted wagering game presentation engine are determined.

At block 623, the extracted wagering game presentation engine is wrapped in an wagering game presentation engine widget shell code, and the determined inputs and outputs are indicated in the shell code.

It should be understood that the depicted flowcharts are examples meant to aid in understanding embodiments and should not be used to limit embodiments or limit scope of the claims. Embodiments may perform additional operations, fewer operations, operations in a different order, operations in parallel, and some operations differently. For instance, referring to FIG. 3, additional operations can be performed in an attempt to resolve widget compatibilities, suggest alternative or additional wagering game widgets, etc. Additional operations can also be performed to evaluate greater combinations of wagering game widgets, perhaps in stages. For example, compatibility can be determined among multiple game logic widgets and then between the compatible multiple game logic widgets and multiple aesthetic asset widgets. Referring to FIG. 6, additional operations can be performed to generate multiple wagering game presentation engine widgets. Additional operations can also be performed to generate output that is not an aesthetic asset (e.g., a widget that generates commands to cause tactile sensations that are associated with wagering game activity). Further, operations can be performed to secure aspects of decomposed wagering games. For example, operations can be performed to encode a wagering game logic widget in a manner that limits Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computer system (or other electronic device(s)) to perform a process according to embodiments, whether presently described or not, since every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

Figure 7:
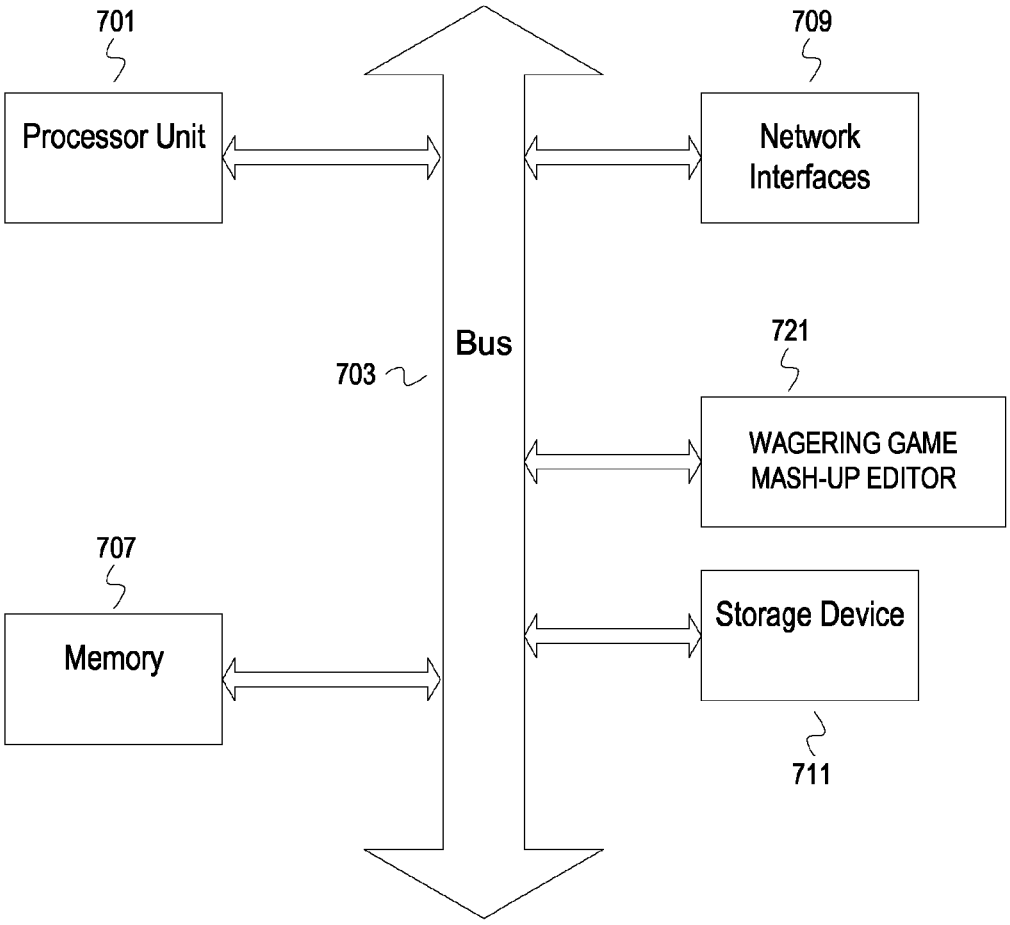
FIG. 7 depicts an example computer system.

FIG. 7 depicts an example computer system. A computer system includes a processor unit 701 (possibly including multiple processors, multiple cores, multiple nodes, and/or implementing multi-threading, etc.). The computer system includes memory 707. The memory 707 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the above already described possible realizations of machine-readable media. The computer system also includes a bus 703 (e.g., PCI bus, ISA bus, PCI-Express bus, HyperTransport® bus, InfiniBand® bus, NuBus bus, etc.), one or more network interfaces 705 (e.g., an ATM interface, an Ethernet interface, a Frame Relay interface, SONET interface, wireless interface, etc.), and a storage device(s) 711 (e.g., optical storage, magnetic storage, etc.). The computer system also comprises a wagering game mash-up editor 721 that constructs a portable wagering game from indicated wagering game widgets. The wagering game mash-up editor can decompose a wagering game to derive wagering game widgets. Any one of these functionalities may be partially (or entirely) implemented in hardware and/or on the processing unit 701. For example, the functionality may be implemented with an application specific integrated circuit, in logic implemented in the processing unit 701, in a co-processor on a peripheral device or card, etc. Further, realizations may include fewer or additional components not illustrated in FIG. 4 (e.g., video cards, audio cards, additional network interfaces, peripheral devices, etc.). The processor unit 701, the storage device(s) 711, and the network interface 705 are coupled to the bus 703. Although illustrated as being coupled to the bus 703, the memory 707 may be coupled to the processor unit 701.

While the embodiments are described with reference to various implementations and exploitations, it will be understood that these embodiments are illustrative and that the scope of the inventive subject matter is not limited to them. In general, techniques for opening links in a sandbox environment as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the inventive subject matter. In general, structures and functionality presented as separate components in the example configurations may be implemented as a combined structure or component. Similarly, structures and functionality presented as a single component may be implemented as separate components. These and other variations, modifications, additions, and improvements may fall within the scope of the inventive subject matter.

The invention claimed is:

1. A method of operating a device separate from a wagering game developer environment, said device configured to combine compatible widgets, from a first wagering game and a second wagering game independent from the first wagering game, into a platform independent wagering game, said method comprising:

evaluating, via one or more electronic processing units of the device, compatibility of a first game logic of the first wagering game with at least one presentation criterion of the second wagering game, wherein the first game logic is implemented by a wagering game logic widget of the first wagering game, wherein the at least one presentation criterion is implemented by a wagering game presentation engine widget of the second wagering game, and wherein at least one of the first wagering game and the second wagering game originates from the wagering game developer environment;

determining, via the one or more electronic processing units of the device, the wagering game logic widget and the wagering game presentation engine widget to be compatible based on said evaluating; and generating the platform independent wagering game with the wagering game logic widget, the wagering game presentation engine widget, one or more aesthetic assets, and a pay table based on the first game logic after determining the wagering game logic widget and the wagering game presentation engine widget to be compatible.

2. The method of claim 1 further comprising generating the pay table for the platform independent wagering game based, at least in part, on the first game logic and indicated wager denominations.

3. The method of claim 1 further comprising evaluating compatibility of a second wagering game logic widget, which implements a second game logic of the first wagering game, with both the wagering game logic widget and the wagering game presentation engine widget.

4. The method of claim 1 further comprising evaluating compatibility of a second wagering game logic widget, which implements a second game logic of a third wagering game, with both the wagering game logic widget and the wagering game presentation engine widget.

5. The method of claim 1 further comprising deploying the platform independent wagering game to an online wagering game community and tracking popularity of the deployed platform independent wagering game.

6. The method of claim 1, wherein the determining that the first game logic is compatible with the at least one presentation criterion of the second wagering game comprises determining that a number of one or more of an expected argument or an expected value is equivalent for the first game logic and the at least one presentation criterion.

7. The method of claim 1, wherein the determining that the first game logic is compatible with the at least one presentation criterion of the second wagering game comprises determining that the first game logic provides an output value expected by the at least one presentation criterion.

8. The method of claim 1, wherein the determining that the first game logic is compatible with the at least one presentation criterion of the second wagering game comprises determining that the first game logic and the at least one presentation criterion accept a same number of events as outputs.

9. The method of claim 1, wherein the determining that the first game logic is compatible with the at least one presentation criterion of the second wagering game comprises:

determining that a first event specified by the first game logic, requires presentation of a first number of aesthetic assets;

determining that a second event, specified by second game logic for the second wagering game, requires as the at least one presentation criterion a second number of aesthetic assets; and determining that the first number of aesthetic assets is equivalent to the second number of aesthetic assets.

10. One or more non-transitory machine-readable storage media having program code stored therein and executable by a machine, the program code comprising program code to:

electronically detect selection, via a game editor accessed by the machine, of a wagering game logic widget that implements first game logic of a first wagering game;

electronically detect selection, via the game editor, of a wagering game presentation engine widget that implements at least one presentation criterion of a second wagering game, wherein at least one of the first wagering game and the second wagering game originates from a wagering game developer environment independent from the machine, and wherein the first wagering game and the second wagering game are independent wagering games;

electronically evaluate compatibility of the first game logic with the at least one presentation criterion of the second wagering game;

determine whether the wagering game logic widget and the wagering game presentation engine widget are compatible based on the evaluation; and generate, via glue code units associated with the game editor, a platform independent wagering game, wherein the glue code units combine the wagering game logic widget, the wagering game presentation engine widget, one or more aesthetic assets, and a pay table based on the first game logic if the wagering game logic widget and the wagering game presentation engine widget are compatible.

11. The one or more non-transitory, machine-readable storage media of claim 10, wherein the program code further comprises program code to generate the pay table for the platform independent wagering game based, at least in part, on the first game logic and indicated wager denominations.

12. The one or more non-transitory, machine-readable storage media of claim 10, wherein the program code further comprises program code to evaluate compatibility of a second wagering game logic widget, which implements a second game logic of the first wagering game, with both the wagering game logic widget and the wagering game presentation engine widget.

13. The one or more non-transitory, machine-readable storage media of claim 10, wherein the program code further comprises program code to evaluate compatibility of a second wagering game logic widget, which implements a second game logic of a third wagering game, with both the wagering game logic widget and the wagering game presentation engine widget.

14. The one or more non-transitory, machine-readable storage media of claim 10, wherein the program code further comprises program code to deploy the platform independent wagering game to an online wagering game community and to track popularity of the deployed platform independent wagering game.

15. A wagering game apparatus comprising:

a processor;

a network communication interface; and a machine-readable storage medium having program code stored therein and executable by the processor, the program code comprising program code to:

connect, via the network communication interface, with a client device independent from a game developer for at least one of a first wagering game and a second wagering game, wherein the client device accesses a game mashup tool provided by the game developer;

electronically receive, via the network communication interface, an indication, via the game mashup tool, of a wagering game logic widget that implements first game logic of the first wagering game and a wagering game presentation widget that implements at least one presentation criterion of the second wagering game, wherein the second wagering game is independent from the first wagering game;

electronically evaluate compatibility of the first game logic with the at least one presentation criterion of the second wagering game;

determine whether the wagering game logic widget and the wagering game presentation engine widget are compatible based on the evaluation; and generate a platform independent wagering game with the wagering game logic widget, the wagering game presentation engine widget, one or more aesthetic assets, and a pay table based on the first game logic if the wagering game logic widget and the wagering game presentation engine widget are compatible.

16. The wagering game apparatus of claim 15, wherein the program code further comprises program code to generate the pay table for the platform independent wagering game based, at least in part, on the first game logic and indicated wager denominations.

17. The wagering game apparatus of claim 15, wherein the program code further comprises program code to evaluate compatibility of a second wagering game logic widget, which implements a second game logic of the first wagering game, with both the wagering game logic widget and the wagering game presentation engine widget.

18. The wagering game apparatus of claim 15, wherein the program code further comprises program code to evaluate compatibility of a second wagering game logic widget, which implements a second game logic of a third wagering game, with both the wagering game logic widget and the wagering game presentation engine widget.

19. The wagering game apparatus of claim 15, wherein the program code further comprises program code to deploy the platform independent wagering game to an online wagering game community and to track popularity of the deployed platform independent wagering game.

20. An apparatus comprising:

a display;

a set of one or more electronic processor units;

means for evaluating compatibility of a plurality of widgets from a plurality of independent wagering games, wherein the plurality of widgets implement at least two of a wagering game logic, a wagering game presentation engine, and aesthetic assets for the plurality of independent wagering games;

means for using one or more glue code units to implement interaction among the plurality of widgets after determining the compatibility; and means for generating a platform independent wagering game from the plurality of widgets determined to be compatible by the evaluating means, wherein the platform independent wagering game is independent from the plurality of independent wagering games.

21. The method of claim 1 further comprising:

validating that the platform independent wagering game does not violate intellectual property rights associated with one or more wagering game developer entities associated with one or more of the first wagering game and the second wagering game.

22. The apparatus of claim 20, wherein the means for evaluating the compatibility of the plurality of widgets comprises means for determining that the at least two of the wagering game logic, the wagering game presentation engine, and the aesthetic assets accept a number of events equivalent to a number of outputs.

* * * * *